US010914097B2

(12) United States Patent
Fonteneau et al.

(10) Patent No.: US 10,914,097 B2
(45) Date of Patent: Feb. 9, 2021

(54) LANDING DOOR LOCK FAILSAFE PROTECTION DEVICE

(71) Applicant: Otis Elevator Company, Farmington, CT (US)

(72) Inventors: Nicolas Fonteneau, Vitry aux Loges (FR); Clement Schach, Orléans (FR); Christophe Taudou, La Bussiere (FR); Raphael Picard, Poilly lez Gien (FR); Thierry Chopineau, Gien (FR); Patrice Degardin, Chatillon sur Loire (FR); Alexandre Renard, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 543 days.

(21) Appl. No.: 15/742,077

(22) PCT Filed: Jul. 10, 2015

(86) PCT No.: PCT/IB2015/001368
§ 371 (c)(1),
(2) Date: Jan. 5, 2018

(87) PCT Pub. No.: WO2017/009678
PCT Pub. Date: Jan. 19, 2017

(65) Prior Publication Data

US 2018/0202189 A1 Jul. 19, 2018

(51) Int. Cl.
*E05B 17/14* (2006.01)
*B66B 13/16* (2006.01)
(Continued)

(52) U.S. Cl.
CPC ..... *E05B 17/147* (2013.01); *B66B 13/16* (2013.01); *B66B 13/24* (2013.01); *E05B 13/00* (2013.01);
(Continued)

(58) Field of Classification Search
CPC ..... E05B 17/147; E05B 13/00; B66B 13/16; B66B 13/24
(Continued)

(56) References Cited

U.S. PATENT DOCUMENTS 3,731,963 A 5/1973 Pond
4,167,104 A 9/1979 Bond
(Continued)

FOREIGN PATENT DOCUMENTS

EP 1845053 A1 10/2007
EP 1873334 A2 1/2008
(Continued)

OTHER PUBLICATIONS

International Search Report, International Application No. PCT/IB2015/001368, dated Apr. 6, 2016, European Patent Office; International Search Report 5 pages.
(Continued)

*Primary Examiner* — David S Warren
(74) *Attorney, Agent, or Firm* — Cantor Colburn LLP

(57) ABSTRACT

A landing door locking mechanism of an elevator system includes a body housing key-engagement elements and having a first end and a second end, the key-engagement elements located at the first end and a keyway structure, wherein in a first position the first end of the body is exposed such that a key may be inserted into a keyway of the keyway structure and interact with the key-engagement elements. A biasing mechanism is configured to bias a moveable portion of the body toward a second position, wherein in the second
(Continued)

position a key cannot interact with the key-engagement elements and a solenoid is configured to apply a force on the moveable portion of the body when the solenoid is energized such that the moveable portion of the body is moved from the second position to the first position.

19 Claims, 6 Drawing Sheets

(51) Int. Cl.

| | |
|---|---|
| ***B66B 13/24*** | (2006.01) |
| ***E05B 47/00*** | (2006.01) |
| ***E05B 35/00*** | (2006.01) |
| ***E05B 13/00*** | (2006.01) |
| ***E05B 65/08*** | (2006.01) |

(52) U.S. Cl.
CPC ..... *E05B 35/008* (2013.01); *E05B 47/0004* (2013.01); *E05B 65/08* (2013.01)

(58) Field of Classification Search
USPC ..... 187/313
See application file for complete search history.

(56) References Cited

U.S. PATENT DOCUMENTS

| | | | | |
|---|---|---|---|---|
| 4,635,035 | A * | 1/1987 | Ratzabi | B60R 25/1001 200/61.66 |
| 4,937,560 | A * | 6/1990 | Nourmand | E05B 47/0603 340/542 |
| 5,337,588 | A * | 8/1994 | Chhatwal | E05B 17/22 264/264 |
| 6,591,644 | B2 * | 7/2003 | Doerr | E05B 47/063 70/278.3 |
| 6,793,253 | B2 * | 9/2004 | Bruwer | E05B 47/0012 292/144 |
| 7,237,655 | B2 * | 7/2007 | Kocher | B66B 5/005 187/314 |
| 7,954,605 | B2 * | 6/2011 | Fonteneau | B66B 5/0087 187/314 |
| 8,544,302 | B2 | 10/2013 | Goldman | |
| 8,746,415 | B2 * | 6/2014 | Aluisetti | B66B 1/468 187/414 |
| 10,414,628 | B2 * | 9/2019 | Terry | B66B 1/468 |
| 10,662,025 | B2 * | 5/2020 | Felder | B66B 1/465 |
| 10,676,321 | B2 * | 6/2020 | Wang | B66B 5/0031 |
| 2003/0062728 | A1 * | 4/2003 | Bruwer | E05B 47/0012 292/201 |
| 2004/0173415 | A1 * | 9/2004 | Kocher | B66B 13/245 187/316 |
| 2005/0006908 | A1 * | 1/2005 | Bruwer | E05B 47/0012 292/144 |
| 2006/0179903 | A1 | 8/2006 | Goldman | |
| 2007/0025828 | A1 * | 2/2007 | Wu | F16B 23/0069 411/402 |
| 2008/0121001 | A1 | 5/2008 | Huang et al. | |
| 2008/0250828 | A1 * | 10/2008 | Bugeja | B60R 25/04 70/255 |
| 2010/0313615 | A1 | 12/2010 | Chen | |
| 2017/0341909 | A1 * | 11/2017 | Fonteneau | E05B 47/0002 |
| 2018/0171661 | A1 * | 6/2018 | Fauconnet | B66B 5/005 |
| 2018/0202189 | A1 * | 7/2018 | Fonteneau | E05B 17/147 |
| 2020/0165839 | A1 * | 5/2020 | Uhlenbrock | E05B 47/0603 |

FOREIGN PATENT DOCUMENTS

| | | | |
|---|---|---|---|
| EP | 2050704 | A1 | 4/2009 |
| EP | 2674922 | A1 | 12/2013 |
| FR | 2947254 | A1 | 12/2010 |
| JP | H0952685 | A | 2/1997 |
| JP | 2000072361 | | 3/2000 |
| JP | 2004218304 | A | 8/2004 |
| JP | 2006020927 | A | 1/2006 |
| KR | 100858587 | B1 | 9/2008 |

OTHER PUBLICATIONS

International Written Opinion, International Application No. PCT/IB2015/001368, dated Apr. 6, 2016, European Patent Office; International Written Opinion 6 pages.

* cited by examiner

LANDING DOOR LOCK FAILSAFE PROTECTION DEVICE

CROSS REFERENCE TO RELATED APPLICATIONS

This is a U.S. National Stage of Application No. PCT/IB2015/001368, filed on Jul. 10, 2015, the disclosure of which is incorporated herein by reference.

BACKGROUND

The subject matter disclosed herein generally relates to landing door locks for elevator systems and, more particularly, to failsafe protection devices for landing door locks.

Elevators may have maintenance performed within an elevator shaft. Accordingly, access must be provided for a technician or other authorized person to gain access to the elevator shaft. Traditional access is provided at each landing of the elevator shaft. That is, operation of the landing doors is performed such that the landing doors may be opened when an elevator is not at the particular landing, so that the technician or other authorized person may gain access to the elevator shaft and perform a desired operation.

Because of safety hazards associated with an elevator shaft, access may be restricted to authorized personnel only. As a result, systems are put in place to prevent and control elevator shaft access, especially for non-authorized persons, in a robust and safe way. Traditionally, landing door opening mechanisms are provided on landing door frames and/or lintels with direct mechanical actuators or locks working with triangular keys. Such a landing door lock is just a simple triangular lock, which may be opened with any triangular key.

SUMMARY

According to one embodiment a landing door locking mechanism of an elevator system is provided. The mechanism includes a body housing key-engagement elements and having a first end and a second end, the key-engagement elements located at the first end and a keyway structure, wherein in a first position the first end of the body is exposed such that a key may be inserted into a keyway of the keyway structure and interact with the key-engagement elements. A biasing mechanism is configured to bias a moveable portion of the body toward a second position, wherein in the second position a key cannot interact with the key-engagement elements and a solenoid is configured to apply a force on the moveable portion of the body when the solenoid is energized such that the moveable portion of the body is moved from the second position to the first position.

In addition to one or more of the features described above, or as an alternative, further embodiments may include that the second end of the body defines a plunger.

In addition to one or more of the features described above, or as an alternative, further embodiments may include that the biasing mechanism is configured between the second end of the body and a surface of the solenoid.

In addition to one or more of the features described above, or as an alternative, further embodiments may include that the biasing mechanism is configured to pull the moveable portion of the body toward the second position.

In addition to one or more of the features described above, or as an alternative, further embodiments may include that the biasing mechanism is a spring.

In addition to one or more of the features described above, or as an alternative, further embodiments may include a controller configured to direct the solenoid to be energized.

In addition to one or more of the features described above, or as an alternative, further embodiments may include that the moveable portion of the body is the entire body.

In addition to one or more of the features described above, or as an alternative, further embodiments may include that the moveable portion of the body is a sleeve.

According to another embodiment, a method of securing an elevator door lock is provided. The method includes biasing a moveable portion of a locking mechanism toward a second position, energizing a solenoid, and urging the moveable portion of the locking mechanism toward a first position, wherein in the first position key-engagement elements of the locking mechanism are accessible through a keyway of the locking mechanism, and in the second position the key-engagement elements are not accessible through the keyway of the locking mechanism.

In addition to one or more of the features described above, or as an alternative, further embodiments may include entering a maintenance mode to energize the solenoid.

In addition to one or more of the features described above, or as an alternative, further embodiments may include, after urging the moveable portion of the locking mechanism toward the first position, the method further includes de-energizing the solenoid and biasing the moveable portion of the locking mechanism toward the second position.

In addition to one or more of the features described above, or as an alternative, further embodiments may include that the moveable portion of the locking mechanism is a body.

In addition to one or more of the features described above, or as an alternative, further embodiments may include that the moveable portion of the locking mechanism is a sleeve.

Technical effects of embodiments of the present disclosure include providing a landing door lock configured to prevent access to the key mechanism of a landing door lock, and thus preventing unauthorized access to an elevator shaft. Further technical effects include a landing door locking mechanism or a portion thereof that is biased or configured such that it may be accessed only when proper authorization is provided.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
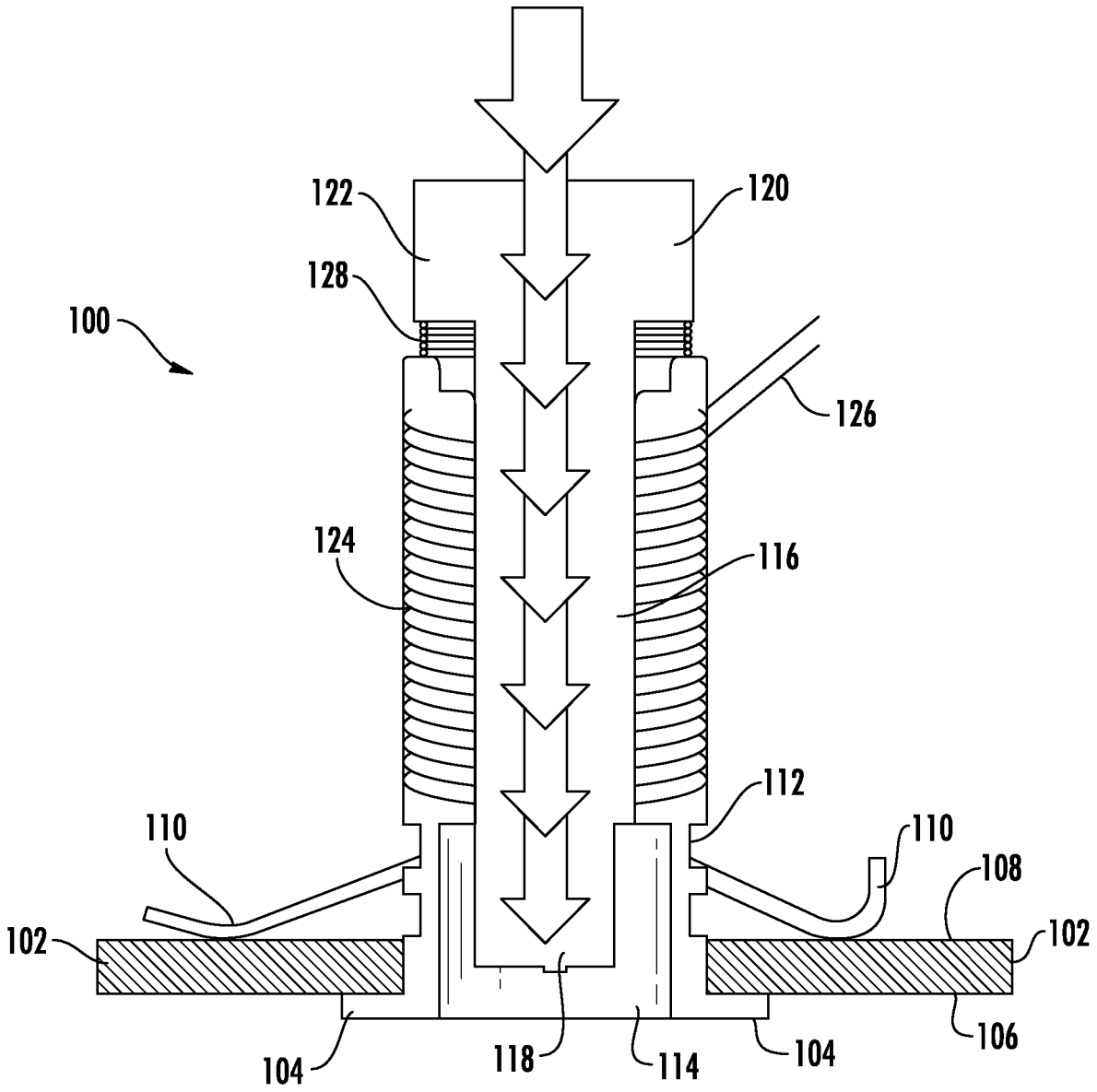
FIG. 1A is a schematic illustration of an example embodiment of a locking mechanism shown in a first position.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. 1 may be labeled "1*a*" and a similar feature in FIG. 2 may be labeled "2*a*." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIGS. 1A-1D show schematic illustrations of a landing door locking mechanism in accordance with a first embodiment of the present disclosure. A landing door locking mechanism 100 is retained within a frame or lintel plate 102. The landing door locking mechanism 100 includes a bushing 104 configured to engage with a first surface 106 of the lintel plate 102. On a second surface 108 of the lintel plate 102 a retainer 110 is configured to bias or engage between an engagement surface 112 of the landing door locking mechanism 100 and the second surface 108 of the lintel plate 102. The retainer 110 may be a washer, spring, clip, or other similar retaining mechanism or device.

The landing door locking mechanism 100 includes a keyway structure 114 that includes a keyway or keyhole (not shown) on a face thereof. The keyway structure 114 enables a key to pass through the keyway and enter the landing door locking mechanism 100 to interact with operating elements of the landing door locking mechanism 100. The operating elements may be pins, rollers, etc. that are engageable or actuable by a key. The keyway in the keyway structure may be a triangular shaped keyway similar to a traditional locking mechanism keyway used in elevator landing door locking mechanisms, as known in the art. However, those of skill in the art will appreciate that the keyway may be of any shape, geometry, or configuration that is configured to operate and receive a key for operating a locking mechanism.

The keyway structure 114, as known in the art, allows a key to be fit into the locking mechanism 100 such that one or more surfaces of the key may interact with operating elements or key-engagement elements (not shown), such as a cylinder, tumbler, pins, etc. of the locking mechanism 100. The key-engagement elements may be housed within a body 116 at a first end 118 of the body 116. The body 116, in some embodiments, may be a cylinder. A plunger 120 may be configured at a second end 122 of the body 116. The body 116 is configured to be moveable relative to the keyway structure 114.

As shown in FIG. 1A, the body 116 is in a first position (see also FIG. 1C), such as an engaged position, wherein the first end 118 of the body 116 is engaged with the keyway structure 114. In the first position, a user is able to insert a key into the keyway of the keyway structure 114 and operate the landing door locking mechanism 100 to unlock a landing door lock and gain access to an elevator shaft. As shown in FIG. 1A, the body 116 is engaged or positioned within the keyway structure 114.

Figure 1B:
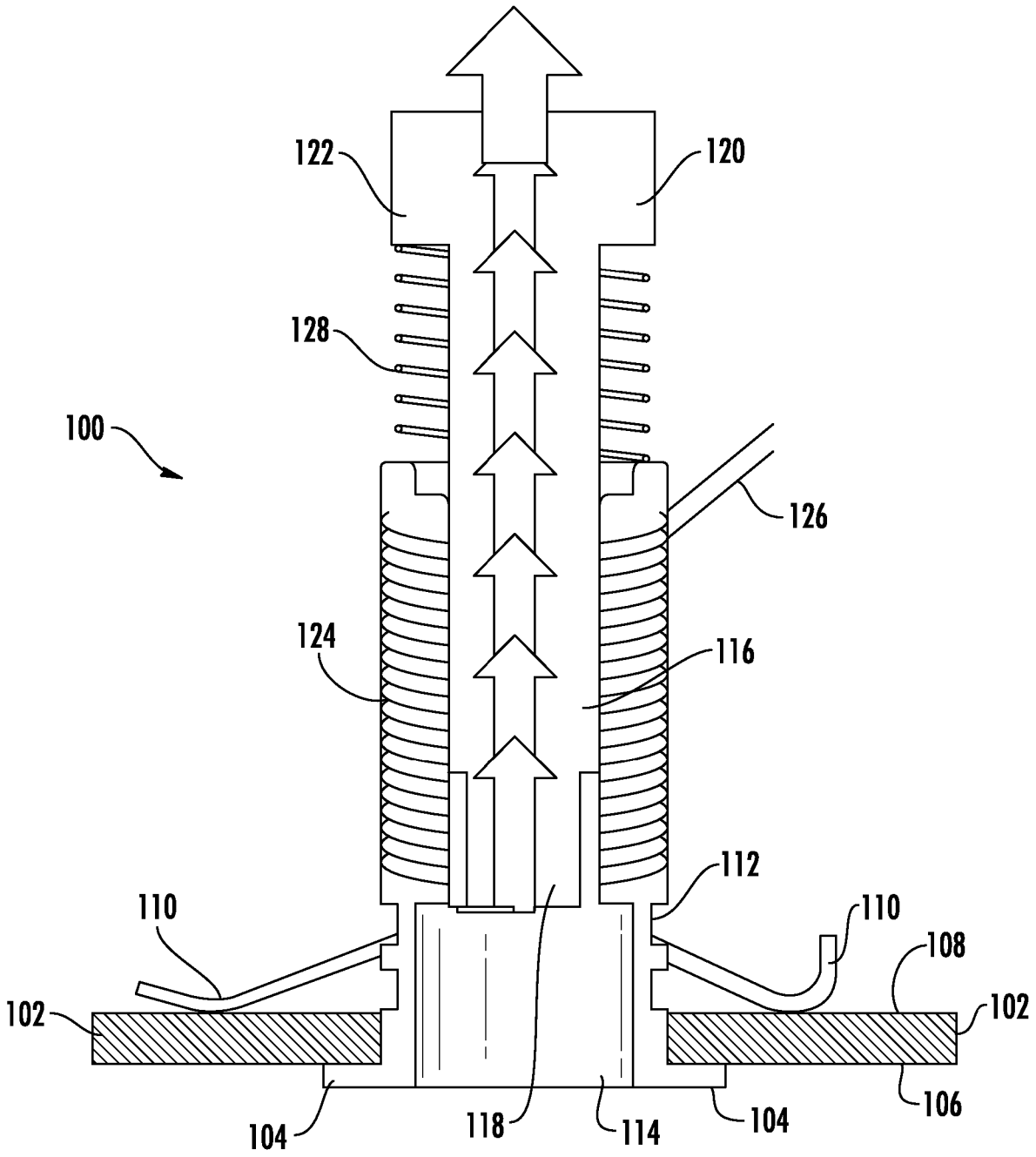
FIG. 1B is schematic illustration of the locking mechanism of FIG. 1A shown in a second position.

Turning now to FIG. 1B, the landing door locking mechanism 100 is shown in a second position (see also FIG. 1D), such as a disengaged position. In this configuration, the first end 118 of the body 116 is retracted or moved away from or out of the keyway structure 114. That is, the body 114 and the key-engagement elements therein are moved away from the keyway within the face of the keyway structure 114. In the second position, the first end 118 of the body 116 does not align with a face of the keyway structure 114. As such, a key that is put through the keyway of the keyway structure 114 may not interact with the key-engagement elements within the body 116, and thus the landing door locking mechanism 100 may not be unlocked.

Figure 1D:
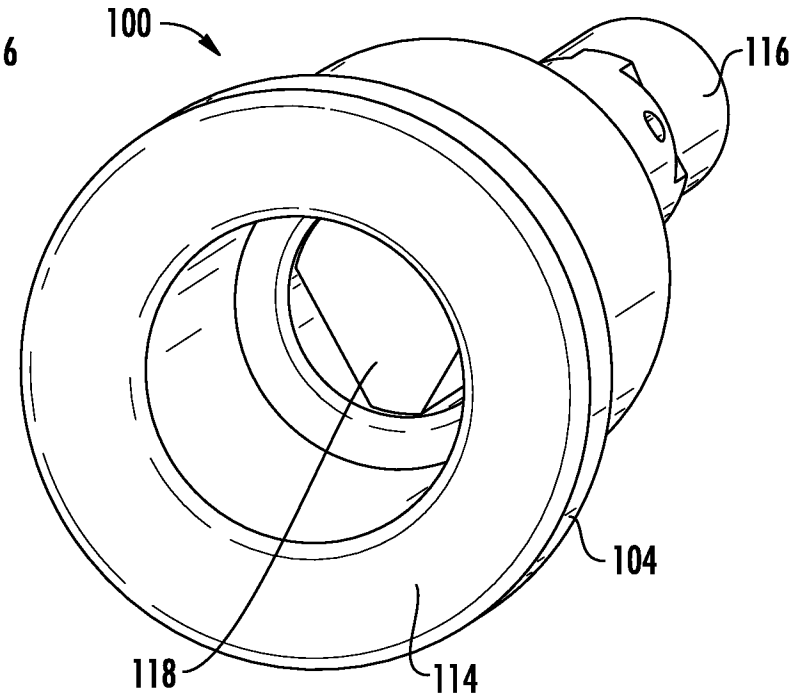
FIG. 1D is a schematic isometric view of the locking mechanism shown in a second position.
Figure 1C:
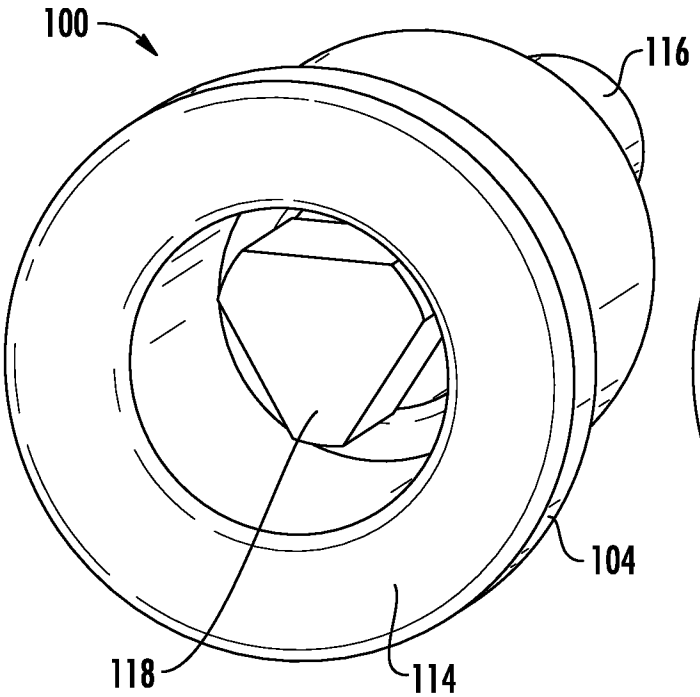
FIG. 1C is a schematic isometric view of the locking mechanism shown in a first position.

In the embodiment shown in FIGS. 1A and 1B, the body 116 is moved between the first position (FIG. 1A; FIG. 1C) and the second position (FIG. 1B; FIG. 1D) by being forced from the second position into the first position. That is, a default or rest position is the second position. In this example, the force applied to the body 116 is provided by an energized solenoid. Thus, as shown in FIGS. 1A and 1B, the body 116 is moveably retained or housed within a solenoid 124. The solenoid 124 may be electrically connected by a wire 126 to a control system or other power system (not shown).

The body 116 or a portion thereof may be made of a magnetic material that is configured to be responsive to a magnetic field that is generated when the solenoid 124 is energized. The magnetic field of the solenoid may be directed such that it applies a force on the body 116 in a direction that is toward the keyway structure 114. As such, when the solenoid 124 is energized, the key-engagement elements within the body 116 may be moved toward and/or into the keyway structure 114. In some embodiments, the key-engagement elements within the body 116 may be moved to be flush with a face of the keyway structure 114. Thus, when the solenoid 124 is energized, a user may put a key through the keyway in the face of the keyway structure 114 to operate the landing door locking mechanism 100.

However, when the solenoid 124 is not energized, no force is applied to the body 116 by a generated magnetic field. The landing door locking mechanism 100 includes a biasing mechanism 128 configured between the plunger 120 of the body 116 and a surface of the solenoid 124.

The biasing mechanism is configured to bias the body 116 toward and into the second position (FIG. 1B) by applying a force on the plunger 120 in a direction away from the keyway structure 114. As such, a force that biases or forces the body 116 toward the second position is constantly applied to the body 116. To move the body 116 into the first position, the force applied by the solenoid 124 is configured to overcome and be greater than the force of the biasing mechanism 128. In some embodiments, the biasing mechanism 128 may be a spring.

Those of skill in the art will appreciate that the biasing mechanism 128 may be configured to act against a different surface than a surface of the solenoid 124. Further, although shown with the biasing mechanism 128 configured between the plunger 120 and the solenoid 124, those of skill in the art will appreciate that the biasing mechanism may be configured in other positions. For example, a spring or other biasing mechanism may be attached to an end surface of the plunger 120 such that the force of the biasing mechanism pulls on the plunger 120 in a direction away from the keyway structure 114, rather than pushing on the plunger 120 in a direction away from the keyway structure 114.

As noted, in some embodiments, the second position is the default position. That is, when no power is present, the biasing mechanism 128 urges the plunger 120 and the body 116 into or toward the second position, preventing access to the key-engagement elements within the body 116. When a user who is authorized to access an elevator shaft desires access, the user may operate a control mechanism, such as a computer or other elevator controller configuration, to thus supply power to the solenoid 124. When the power is supplied to the solenoid 124, the solenoid 124 becomes energized and generates a magnetic field which will act upon the body 116 or a portion thereof. When the magnetic field is present, the force acting upon the body 116 will overcome the force of the biasing mechanism 128 and move the body 116 into the first position, allowing access to the key-engagement elements within the body 116. With the body 116 in the first position, a user can insert a key into through a keyway and into the key-engagement elements within the body 116 to thus open a locked landing door.

To move between the second position and the first position, an action may be performed by a user that is authorized. For example, a controller (not shown) and software installed there may be configured to pilot and provide authorization to rend locks accessible for an authorized person. In such an embodiment, an authorized person may initiate a specific, controlled elevator operation mode in a control cabinet. This mode may energize some or all of the solenoids of the system, i.e., each associated with a landing door of an elevator shaft, thus allowing the authorized person to open a desired landing door and gain access to the elevator shaft.

Figure 2A:
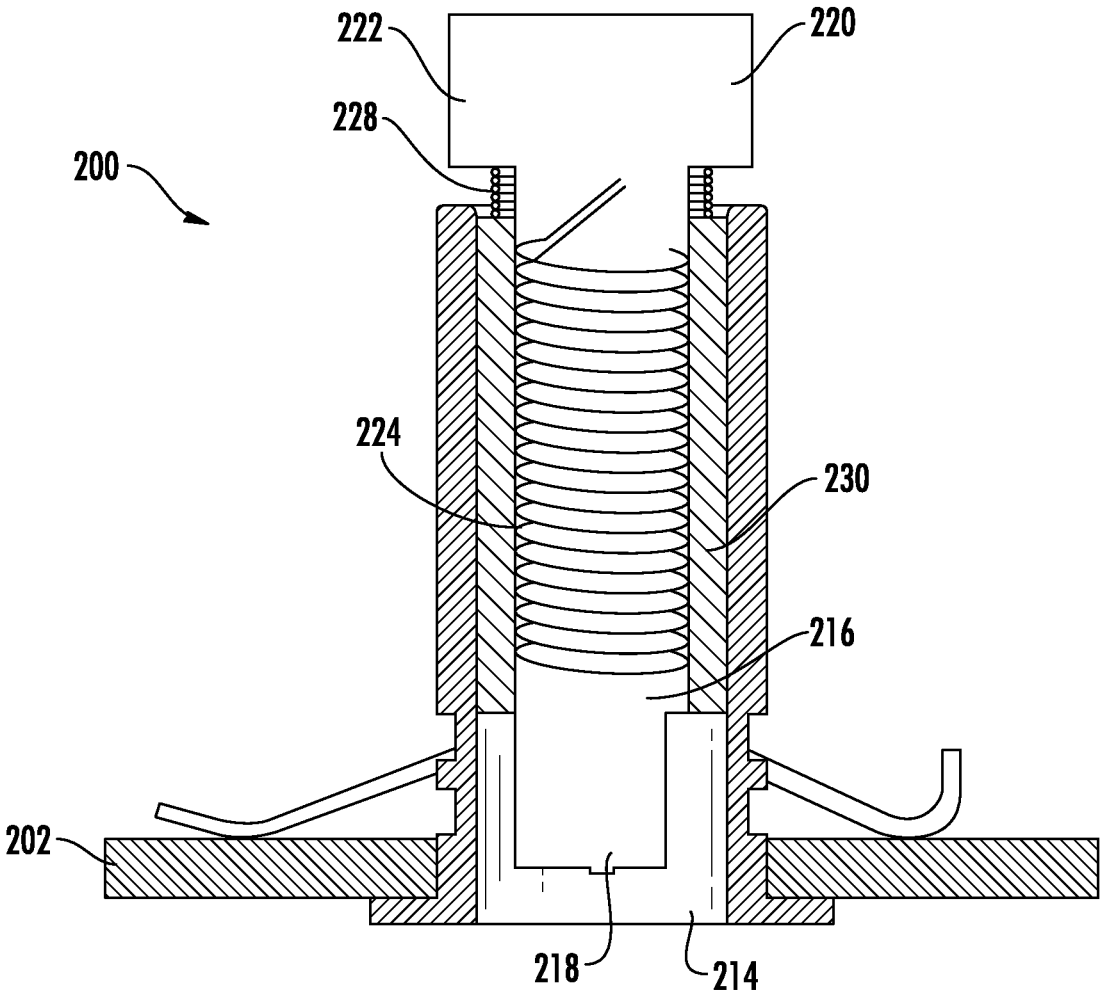
FIG. 2A is a schematic illustration of a second embodiment of a locking mechanism shown in a first position.
Figure 2B:
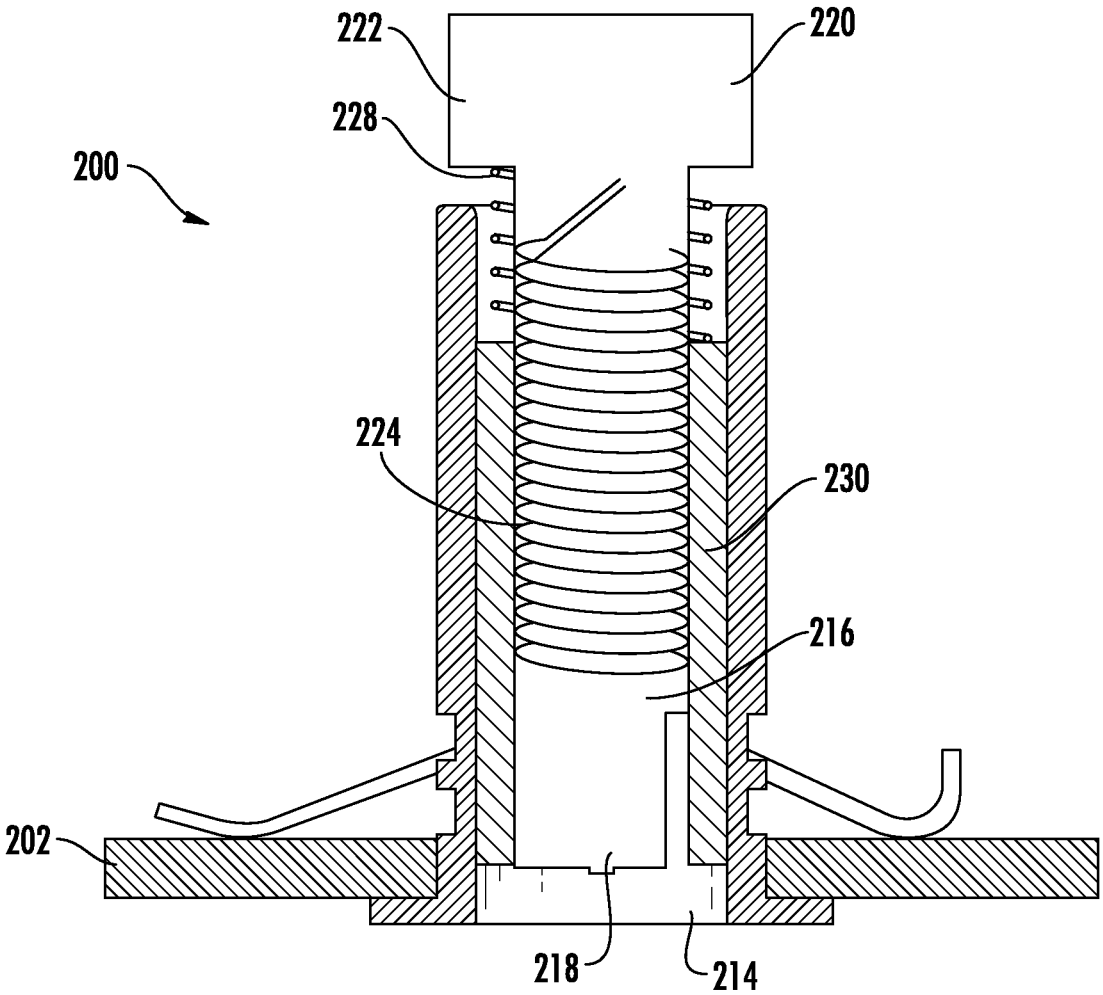
FIG. 2B is a schematic illustration of the locking mechanism of FIG. 2A shown in a second position.

Turning now to FIGS. 2A and 2B, and alternative example embodiment is shown. Similar to FIGS. 1A and 1B, FIG. 2A shows a landing door locking mechanism 200 in a first position, and FIG. 2B shows the landing door locking mechanism 200 in a second position.

As will be appreciated by those of skill in the art, the configuration shown in FIGS. 2A-2B is substantially similar to the configuration shown in FIGS. 1A-1D, and thus the similar features will not be described again. The primary difference between the two embodiments is the operation of movement between the first position and the second position.

In the landing door locking mechanism 200 of FIGS. 2A and 2B, the body 216 of the landing door locking mechanism 200 includes a sleeve 230 that is configured to move relative to the lintel plate 202 while the rest of the body 216 remains stationary relative to the lintel plate 202. The sleeve 230 is moveable between the first position (FIG. 2A) and the second position (FIG. 2B). In the first position, such as an engaged position, the solenoid may be engaged allowing for access to the body 216 and in the second position the solenoid may be disengaged preventing access to the body 216.

In the first position (FIG. 2A) the solenoid 224 is energized by a power source which forces the sleeve 230 to move toward the plunger 220 at the second end 222 of the body 216. In the first position, the sleeve 230 compresses the biasing mechanism 228 between the sleeve 230 and the plunger 220. With the sleeve 230 in this position, the first end 218 of the body is exposed within the keyway structure 214 and the landing door locking mechanism 200 may be operated by allowing a key to enter the keyway structure 214 and engage with the first end 218 of the body 216.

In contrast, when power is removed from the solenoid 224 and/or the solenoid 224 is de-energized, the sleeve 230 may move toward the lintel plate 202 to slide around the first end 218 of the body 216. This is because the biasing mechanism 228 will provide a biasing force against the sleeve 230 and urged the sleeve 230 toward the lintel plate 202. The sleeve 230 thus prevents access of a key to the first end 218 of the body 216.

Figure 3:
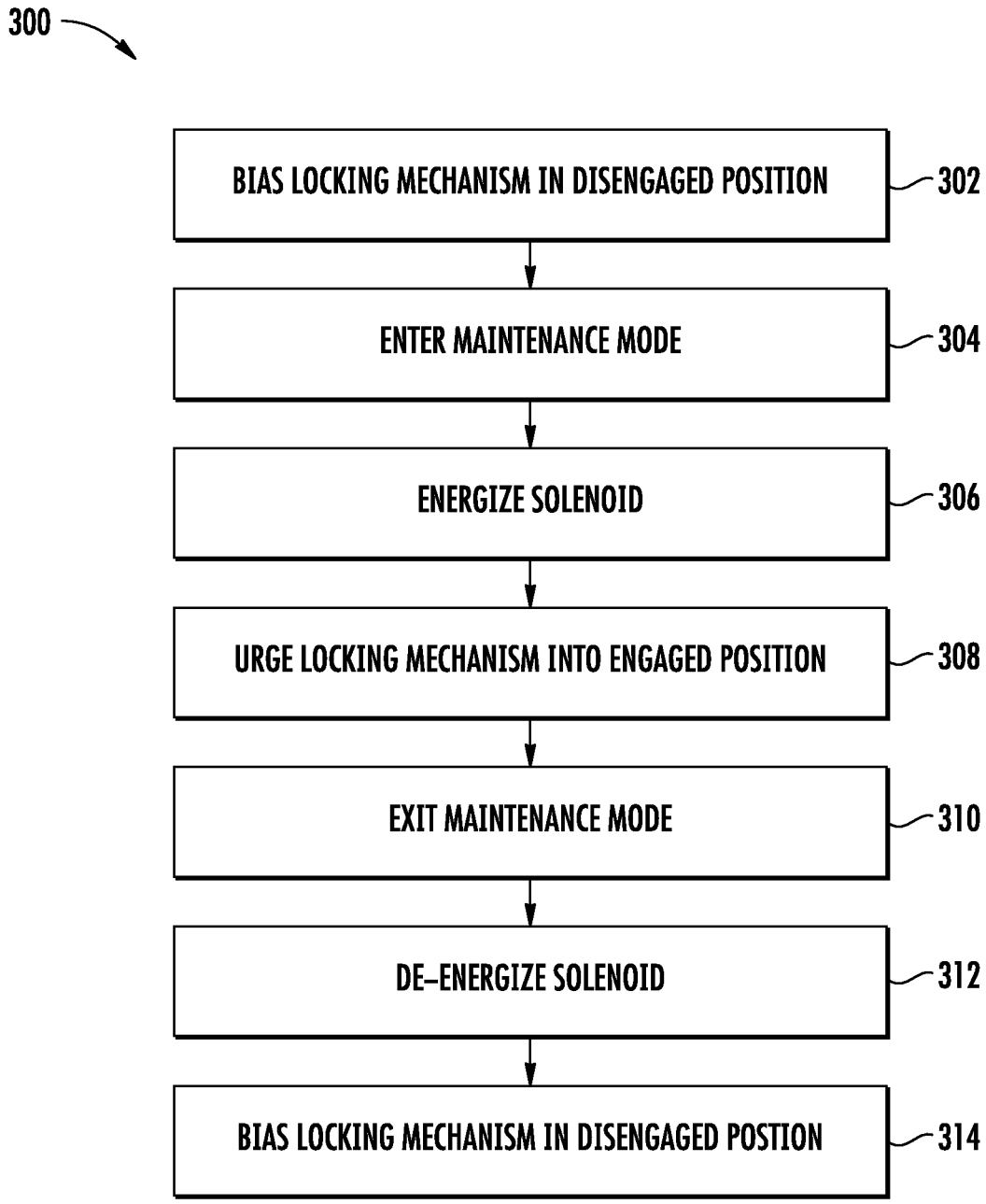
FIG. 3 is a process of operating an elevator landing door locking mechanism in accordance with the present disclosure.

Turning now to FIG. 3, a process of providing a failsafe protection to a landing door lock and thus prevent unauthorized access to an elevator shaft is shown. Process 300 may be performed with the devices described above or may be used with other landing door lock configurations that employ features described herein.

At step 302, a locking mechanism is biased in a disengaged position. The locking mechanism may include a biasing mechanism that is configured to bias the locking mechanism into the disengaged position. In some embodiments, the locking mechanism may include a solenoid that is configured to generate a magnetic field when energized that applies a force to a portion of the locking mechanism to overcome the force applied by the biasing mechanism.

At step 304, the system may be entered into a maintenance mode or other designated mode. With activation of the maintenance mode at step 306, at step 306 the solenoid of the locking mechanism may be energized.

At step 308, a force is applied to urge the locking mechanism such that the locking mechanism is moved from the disengaged position to an engaged position. For example, the magnetic field generated by the energized solenoid pushes or forces the locking mechanism into an engaged position such that a keyway is accessible.

After step 308, a user, such as an authorized technician may insert a key into the keyway and operating the locking mechanism to unlock a landing door and gain access to an elevator shaft. The user or technician may then perform any necessary operations, repairs, inspections, etc. Once the technician is finished, the reverse process may be performed to lock the landing doors and prevent future access to the elevator shaft.

Thus, at step 310 the system may be changed out of a maintenance mode. By exiting the maintenance mode at step 310, power is removed from being applied to the solenoid thus de-energizing the solenoid at step 312. Finally, without the force applied by the solenoid, at step 314, the locking mechanism is returned to the disengaged position.

Advantageously, embodiments described herein provide a failsafe device for preventing access to elevator shafts except when operated by authorized personnel. Advantageously, embodiments disclosed herein may be configured to physically remove access to key-engagement elements of a locking mechanism.

Further, advantageously, various embodiments, are configured to rend inaccessible a triangular shape of the landing door lock either by retracting a triangular plunger inside the lock (in order then to hide the triangular male shape) or by extending the female shape around the triangular shape (in order then to have a flush and flat surface on the lintel side). In some embodiments, a low voltage solenoid is configured to move either the triangular plunger inside the lock or the female housing around the fixed triangular shape. Advantageously, landing door locks equipped by this device may be rendered inaccessible without powering the solenoids (positively safe with compression springs or other biasing mechanisms).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although described herein with respect to a triangular key and keyway, those of skill in the art will appreciate that any key configuration, geometry, shape, size, etc. may be employed without departing from the scope of the disclosure. Furthermore, for example, those of skill in the art will appreciate that the landing door locking mechanisms described herein may be configured within a rod, hollow shaft or cylinder, or other housing that is configured to support and/or protect the landing door locking mechanism.

Accordingly, the present disclosure is not to be seen as limited by the foregoing description, but is only limited by the scope of the appended claims.

What is claimed is:

1. A landing door locking mechanism of an elevator system comprising:

a body housing key-engagement elements and having a first end and a second end, the key-engagement elements located at the first end;

a keyway structure, wherein in a first position the first end of the body is exposed such that a key may be inserted into a keyway of the keyway structure and interact with the key-engagement elements;

a biasing mechanism configured to bias a moveable portion of the body toward a second position, wherein in the second position a key cannot interact with the key-engagement elements; and a solenoid configured to apply a force on the moveable portion of the body when the solenoid is energized such that the moveable portion of the body is moved from the second position to the first position, wherein the second end of the body defines a plunger.

2. The landing door locking mechanism of claim 1, wherein the biasing mechanism is configured between the second end of the body and a surface of the solenoid.

3. The landing door locking mechanism of claim 1, wherein the biasing mechanism is configured to pull the moveable portion of the body toward the second position.

4. The landing door locking mechanism of claim 1, wherein the biasing mechanism is a spring.

5. The landing door locking mechanism of claim 1, further comprising a controller configured to direct the solenoid to be energized.

6. The landing door locking mechanism of claim 1, wherein the moveable portion of the body is the entire body.

7. The landing door locking mechanism of claim 1, wherein the moveable portion of the body is a sleeve.

8. A landing door locking mechanism of an elevator system comprising:

a body housing key-engagement elements and having a first end and a second end, the key-engagement elements located at the first end;

a keyway structure, wherein in a first position the first end of the body is exposed such that a key may be inserted into a keyway of the keyway structure and interact with the key-engagement elements;

a biasing mechanism configured to bias a moveable portion of the body toward a second position, wherein in the second position a key cannot interact with the key-engagement elements; and a solenoid configured to apply a force on the moveable portion of the body when the solenoid is energized such that the moveable portion of the body is moved from the second position to the first position, wherein the moveable portion of the body is the entire body.

9. The landing door locking mechanism of claim 8, wherein the second end of the body defines a plunger.

10. The landing door locking mechanism of claim 9, wherein the biasing mechanism is configured between the second end of the body and a surface of the solenoid.

11. The landing door locking mechanism of claim 8, wherein the biasing mechanism is configured to pull the moveable portion of the body toward the second position.

12. The landing door locking mechanism of claim 8, wherein the biasing mechanism is a spring.

13. The landing door locking mechanism of claim 8, further comprising a controller configured to direct the solenoid to be energized.

14. A landing door locking mechanism of an elevator system comprising:

a body housing key-engagement elements and having a first end and a second end, the key-engagement elements located at the first end;

a keyway structure, wherein in a first position the first end of the body is exposed such that a key may be inserted into a keyway of the keyway structure and interact with the key-engagement elements;

a biasing mechanism configured to bias a moveable portion of the body toward a second position, wherein in the second position a key cannot interact with the key-engagement elements; and a solenoid configured to apply a force on the moveable portion of the body when the solenoid is energized such that the moveable portion of the body is moved from the second position to the first position, wherein the moveable portion of the body is a sleeve.

15. The landing door locking mechanism of claim 14, wherein the second end of the body defines a plunger.

16. The landing door locking mechanism of claim 15, wherein the biasing mechanism is configured between the second end of the body and a surface of the solenoid.

17. The landing door locking mechanism of claim 14, wherein the biasing mechanism is configured to pull the moveable portion of the body toward the second position.

18. The landing door locking mechanism of claim 14, wherein the biasing mechanism is a spring.

19. The landing door locking mechanism of claim 14, further comprising a controller configured to direct the solenoid to be energized.

* * * * *